US005601473A

United States Patent [19]

Strain et al.

[11] Patent Number: 5,601,473

[45] Date of Patent: Feb. 11, 1997

[54] SKATE SHARPENING APPARATUS AND METHOD

[75] Inventors: Randy L. Strain, Minneapolis; Jeffrey P. Jannetto, White Bear Lake Township; Robert M. Evans, North Branch, all of Minn.

[73] Assignee: M.J.S. Manufacturing, Inc., Minneapolis, Minn.

[21] Appl. No.: 396,185

[22] Filed: Feb. 24, 1995

Related U.S. Application Data

[63] Continuation-in-part of Ser. No. 161,660, Dec. 3, 1993, abandoned.

[51] Int. Cl.[6] ..... B24B 3/40; B24B 47/02; B24B 49/03

[52] U.S. Cl. ..... 451/5; 451/10; 451/14; 451/224; 451/229; 451/383; 451/393

[58] Field of Search ..... 76/83; 451/5, 9, 451/10, 11, 14, 224, 229, 365, 377, 383, 392, 393

[56] References Cited

U.S. PATENT DOCUMENTS

| | | |
|---|---|---|
| 2,850,926 | 9/1958 | Jobe . |
| 3,060,644 | 10/1962 | Wisti . |
| 3,279,321 | 10/1966 | Muhl . |
| 3,415,017 | 12/1968 | Murray . |
| 3,719,006 | 3/1973 | Vezeau . |
| 3,735,533 | 5/1973 | Salberg . |
| 3,827,185 | 8/1974 | Smith . |
| 3,948,001 | 4/1976 | Miyazawa et al. . |
| 3,988,124 | 10/1976 | Babcock . |
| 3,988,865 | 11/1976 | Weisman . |
| 4,055,026 | 10/1977 | Zwicker . |
| 4,094,101 | 6/1978 | Robinson . |
| 4,235,050 | 11/1980 | Hannaford et al. . |
| 4,392,332 | 7/1983 | Sakcriska . |
| 4,558,541 | 12/1985 | Consay . |
| 4,722,152 | 2/1988 | Ek et al. . |
| 4,817,339 | 4/1989 | Weidmo et al. . |
| 5,009,039 | 4/1991 | Lager et al. . |
| 5,127,194 | 7/1992 | Jobin . |
| 5,287,657 | 2/1994 | Tschida et al. . |

*Primary Examiner*—Timothy V. Eley
*Attorney, Agent, or Firm*—Merchant, Gould, Smith, Edell, Welter & Schmidt, P.A.

[57] ABSTRACT

An apparatus and method for sharpening skate blades operate by measuring the length of a skate blade, determining a predetermined profile corresponding to a desired radius of curvature for the blade, and coordinating the motion of a grinding wheel and the blade to grind the blade according to the predetermined profile. A grinding force is applied by the grinding wheel against the blade using a stepper motor coupled through a screw drive, thereby not allowing the grinding wheel to chatter or bounce against the blade. In addition, the blade is clamped end-to-end by a clamping assembly that also determines the length of the blade via the position of the clamp.

29 Claims, 10 Drawing Sheets

FIG. 5A
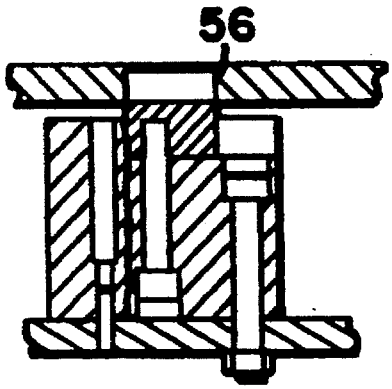
FIG. 5B
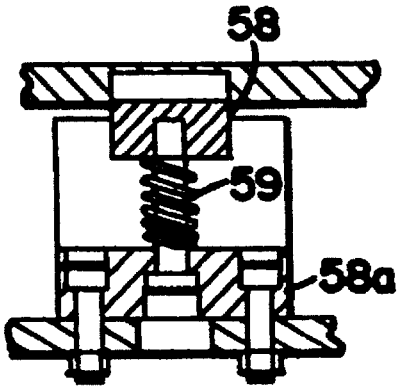
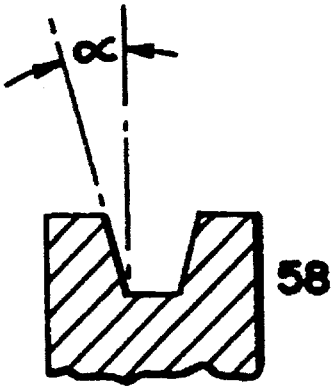
FIG. 5C

SKATE SHARPENING APPARATUS AND METHOD

This application is a continuation-in-part of U.S. Ser. No. 08/161,660 filed Dec. 3, 1993 now abandoned.

FIELD OF THE INVENTION

The present invention relates to an apparatus and method for automatically sharpening an ice skate blade.

BACKGROUND OF THE INVENTION

Different apparatus and methods for automatically sharpening ice skate blades are known. The most common of those systems employ counterweights to provide constant pressure of the grinding wheel against the skate blade over the full length of the blade.

The use of constant pressure alone to control the grinding of the ice skate blade in combination with grinding of the entire length of the blade can, however, cause problems. In particular, such systems tend to remove more of the metal of the blade from the end portions rather than from the center. That situation occurs because the uniform force applied by the counterweight is in a fixed direction while the skate blade typically curves upward at both ends, causing the applied force to increase along the end portions of the blade which are curved upwardly away from the grinding wheel. Examples of such machines can be found in U.S. Pat. No. 3,735,533 to Salberg and U.S. Pat. No. 3,827,185 to Smith.

U.S. Pat. No. 4,235,050 to Hannaford et al. discloses one attempt to compensate for the increased grinding at the ends of the blade by varying the force with which the grinding wheel is pressed against the blade. The grinding wheel force is varied based on the grinding resistance as sensed by measuring the power input to the motor driving the grinding wheel. That system does not, however, fully compensate for the problem of increased grinding at the distal ends of a skate blade. Furthermore, the apparatus required to practice the method is particularly complex, adding to its cost and the cost of maintenance.

U.S. Pat. No. 4,558,541 discloses yet another system for sharpening skate blades in which the blade is swung past a stationary grinding wheel. This machine relies on varying the speed with which the blade is moved past the grinding wheel to control the depth of grinding on the blade. The system varies the speed of the blade by using photodetectors which indicate the position of the blade with reference to the grinding wheel. Once the position of the blade is known, the speed of the blade relative to the grinding wheel can be increased or decreased to control the depth of grinding. That system suffers, however, from additional disadvantages, not the least of which is the complexity of the equipment which increases the cost and difficulty of maintaining the apparatus.

A brief discussion of the profiles of skate blades may be helpful for an understanding of the disadvantages of known automatic skate blade sharpening apparatus. Basically, a skate blade is constructed to have a bottom surface defining an arc of a fixed radius. A blade has a center region (a "flat") where the blade contacts the surface of the ice much of the time, and the blade is curved upward and off of the ice on either side of this region. It will be appreciated, however, that the "flat" of the blade is typically not linear, but is also curved when fully sharpened.

The radius of the blade, and therefore, the effective length of the flat, varies depending on the type of skate to which the blade is attached. A larger radius typically provides a skater with more speed, while a shorter radius provides increased maneuverability. A hockey skate typically has a radius which is approximately 9, 11 or 13 feet. A goalie skate (also for hockey) includes a substantially larger radius, typically about 28 feet. Figure skates typically have a radius of about 4 feet, and also include a notched area at the forward end of the blade for stopping. In some instances, individuals may vary the radius of any of the above designs to provide a better balance between speed and maneuverability.

In addition, it has been found that the curvature of a blade should generally be centered to balance a skater on the blade. If the curvature is modified, e.g., by filing off more of the blade at the front or back, the center of gravity for the skater may be shifted, which may strain a skater's back or knees or make skating more difficult.

All of the above systems also use counterweights to provide a force biasing the grinding wheel against the skate blade. One primary disadvantage associated with a counterweight balance grinding wheel is the tendency of the wheel to bounce or chatter on the blade, thereby forming gouges and other discontinuities to the blade. Furthermore, the counterweights typically need periodic adjustment to provide the desired level of pressure as the grinding wheel is worn away and other variables vary the weight which the counterweight is balancing against.

Moreover, many prior systems cause the grinding wheel to ride along the previous profile of a blade. Thus, these systems are not capable of correcting for defects in a blade, e.g., due to improper manual sharpening in the past or due to nicks in a blade. Once the profile of a blade is changed substantially from the manufacturer's original specifications, none of these systems is capable of returning the blade to its original profile.

Therefore, a need exists in the art for an automatic skate sharpening apparatus and method for sharpening a skate blade in such a manner that prior defects in the skate blade are corrected. Moreover, a need exists for an apparatus and method which may address the various disadvantages associated with the use of counterweights and the like.

SUMMARY OF THE INVENTION

The present invention provides an apparatus and method of automatically sharpening skate blades in which a grinding wheel follows a predetermined profile to provide a desired curvature for a skater and/or to correct prior defects in the skate blade. By a "predetermined profile", what is meant is a controlled movement between a grinding wheel and a skate blade in one or more directions and in a manner which is substantially independent of (i.e., does not necessarily follow) any pre-existing profile of the blade prior to sharpening.

In a preferred apparatus and method, the length of each individual blade length may be measured and used to automatically calculate the predetermined profile used for sharpening the blade. Moreover, a motor coupled to the grinding wheel may be used to apply a grinding force against the blade without allowing the grinding wheel to chatter or bounce against the blade. Further, the blade may be clamped end-to-end during the grinding process.

Therefore, in accordance with one aspect of the invention, there is provided an apparatus for sharpening an ice skate blade. The apparatus includes a clamping assembly for clamping the blade; a grinding wheel; a first motor for varying the spatial relationship between the clamping assembly and the grinding wheel in a direction generally parallel to a longitudinal axis of the blade; a second motor for varying the spatial relationship between the clamping assembly and the grinding wheel in a direction generally perpendicular to a bottom surface of the blade, wherein the second motor applies a grinding force for the grinding wheel against the blade; and a controller for activating the first and second motors to grind the blade.

In accordance with an additional aspect of the invention, there is provided an apparatus for sharpening an ice skate blade. The apparatus includes clamping means for clamping the blade in a fixed position; grinding means for grinding the blade; first moving means for varying the spatial relationship between the clamping means and the grinding means in a direction generally parallel to a longitudinal axis of the blade; second moving means for varying the spatial relationship between the clamping means and the grinding means in a direction generally perpendicular to a bottom surface of the blade; and control means for activating the first and second moving means to grind the blade according to a predetermined profile.

According to a further aspect of the invention, there is provided a method of automatically sharpening an ice skate blade, which includes the step of controlling the movement of a rotating grinding wheel relative to the blade in first and second directions such that the grinding wheel grinds the blade according to a predetermined profile, the first direction being generally parallel to a longitudinal axis of the blade, and the second direction being generally perpendicular to a bottom surface of the blade.

These and other further advantages and features, which characterize the invention, are set forth in the claims annexed hereto and forming a further part hereof. However, for a better understanding of the invention, and the advantages and objectives attained by its use, reference should be made to the Drawing, and to the accompanying descriptive matter, in which there is described a preferred embodiment of the invention.

BRIEF DESCRIPTION OF THE DRAWING

FIG. 5A is an enlarged partial view in cross-section along line 5A—5A in FIG. 5.

FIG. 5B is an enlarged partial view in cross-section along line 5B—5B in FIG. 5.

FIG. 5C is an enlarged partial view in cross-section along line 5C—5C in FIG. 5.

DETAILED DESCRIPTION OF THE PREFERRED EMBODIMENTS

Figure 1:
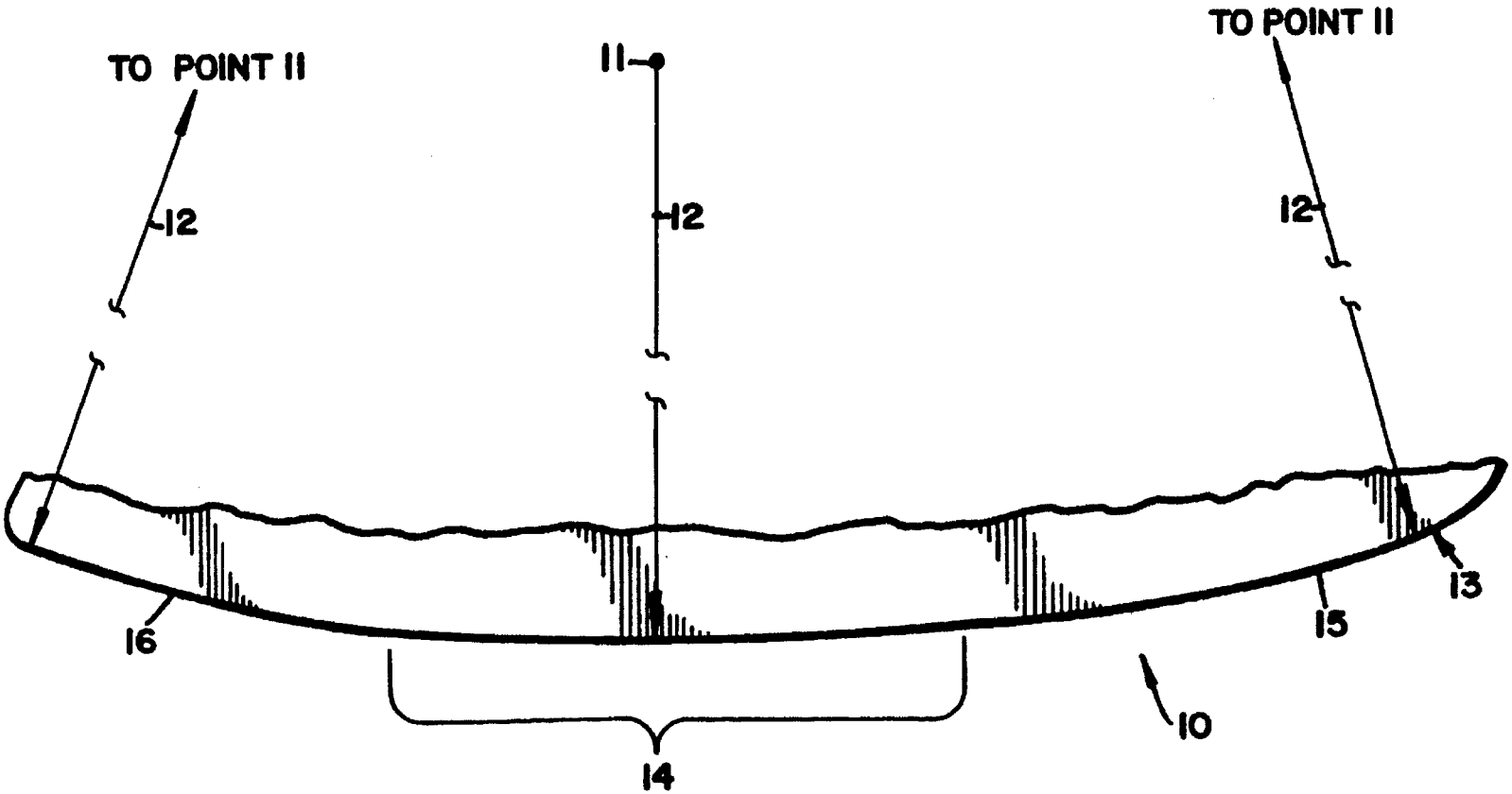
FIG. 1 is a side elevational view of a typical skate blade, showing the radius defined thereon.

Before beginning the description of the preferred embodiments, a brief description of the profiles of skate blades will be provided with reference to FIG. 1.

A bottom portion of a skate blade 10 is depicted in which the profile of the bottom edge 13 defines an arc having a fixed radius (e.g., of length 12 as the bottom edge revolves about a point 11). A blade flat 14 is defined in the center region of the blade, representing the portion which generally contacts the surface of the ice during skating. Each end located on either side of the flat 14, indicated as reference numerals 15 and 16, is rockered upward from the flat 12. It will be understood that the distal end of one end of blade 10 will be provided with notches if the blade 10 is a figure skate blade.

The radius of blade 10 varies depending on the type of skate to which the blade is attached. As discussed above, a typical hockey skate is typically manufactured with a radius of about 9, about 11 or about 13 feet. A goalie skate for hockey will include a radius of about 28 feet. A figure skate blade 10 will typically include a radius of about 4 feet. The radius of any type of skate, however, may vary based on individual preferences which balance speed of the blade 10 against maneuverability. In other words, a shorter radius (and thus a shorter flat section 12) will provide a more maneuverable skate while a longer radius should provide a faster skate.

Figure 2:
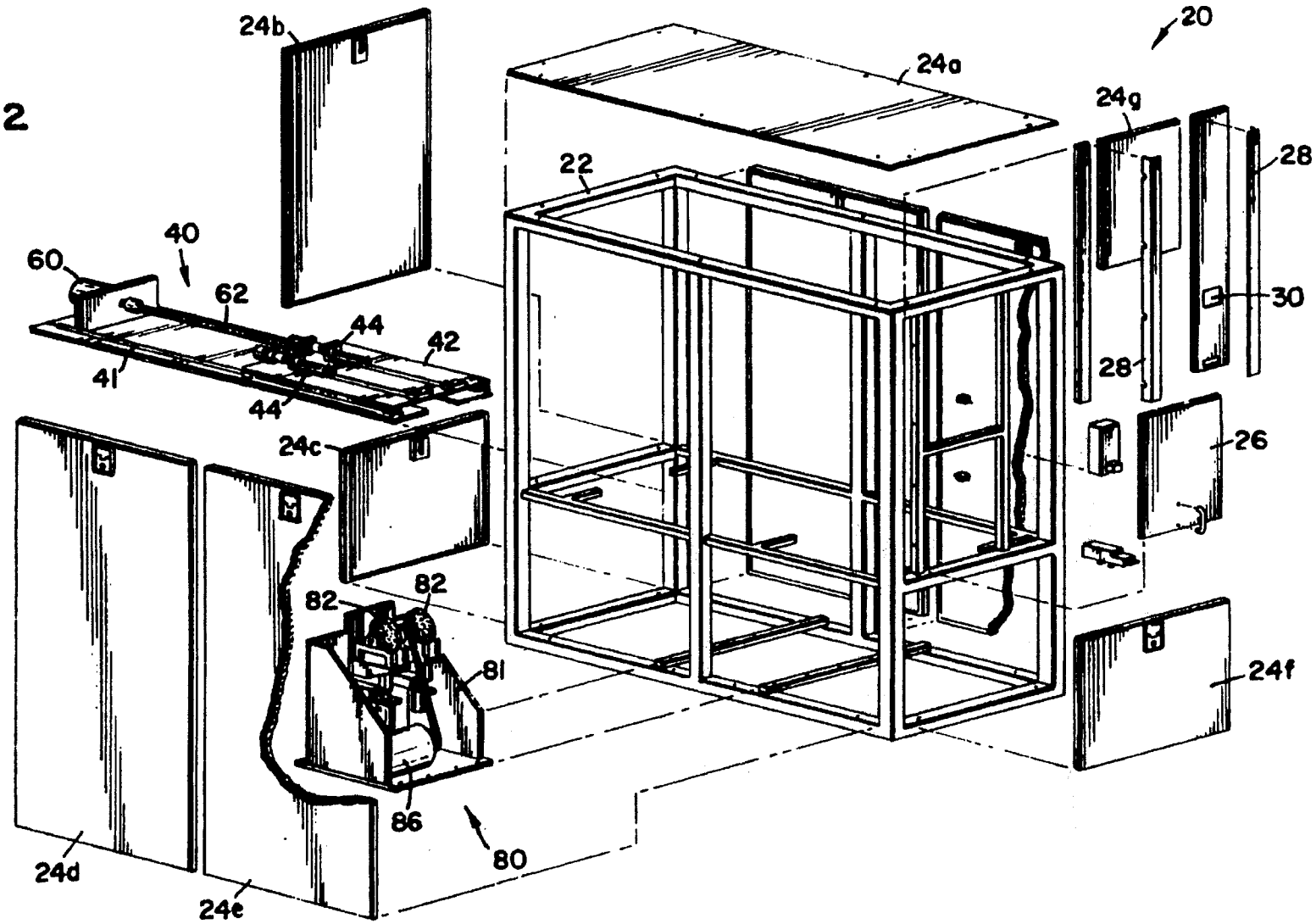
FIG. 2 is an exploded perspective view of a preferred apparatus consistent with the present invention.

Turning now to the preferred apparatus for practicing a preferred method consistent with the invention, FIG. 2 depicts an exploded view of one preferred apparatus consistent with the invention. The apparatus 20 includes a frame 22 to which a top end and side panels 24*a*–24*g* are attached. Preferably, side panels 24*b, c, d, e,* and *f* are easily removable to allow for maintenance of the equipment within apparatus 20.

The front of apparatus 20 includes a sliding door 26 which slides upward in tracks 28 provided on the front of apparatus 20. Sliding door 26 is used to provide access to the sharpening compartment to allow an individual to place skates within the apparatus 20.

Figure 3:
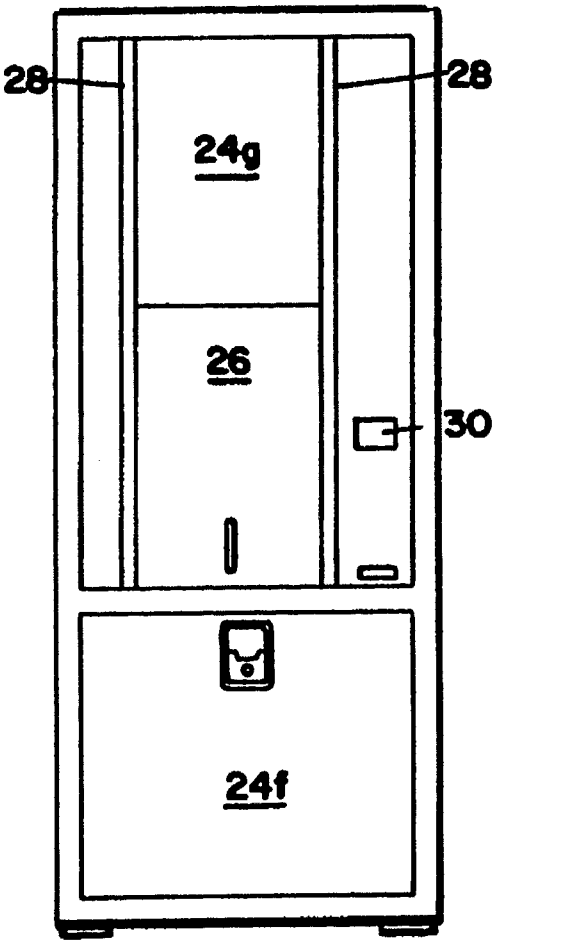
FIG. 3 is a side elevational view of the apparatus of FIG. 2 with portions of the side wall cut away.
Figure 4:
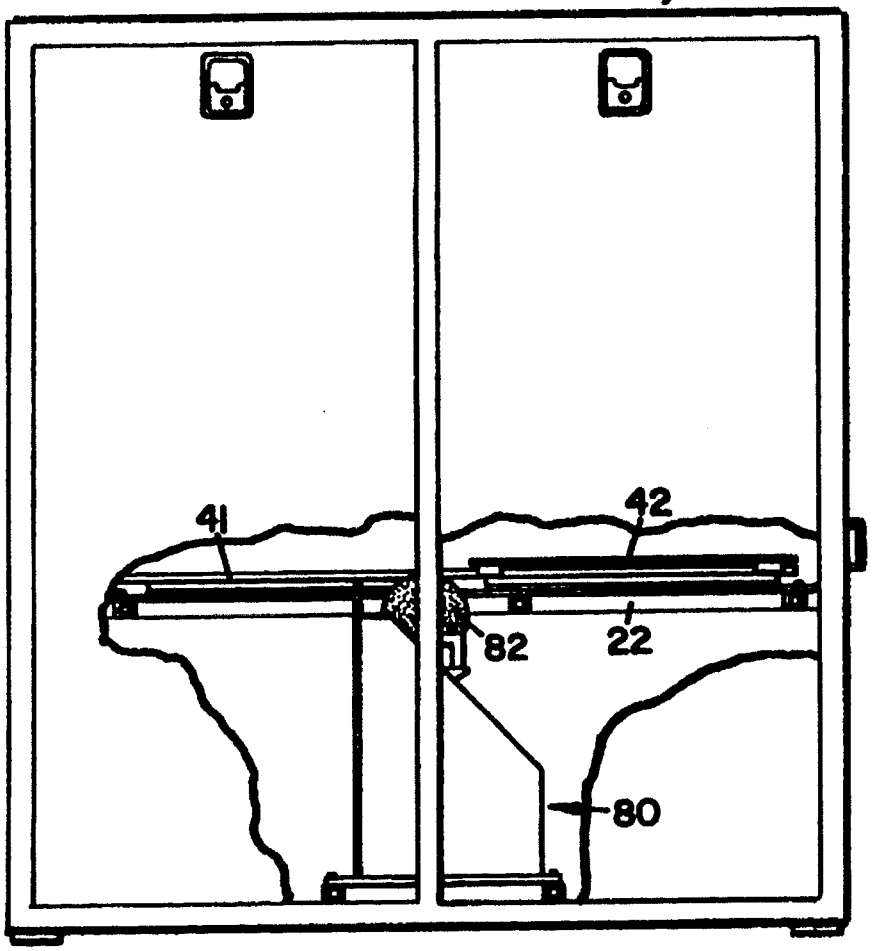
FIG. 4 is a front elevational view of the apparatus of FIG. 2.

Referring now to FIG. 3, the front of apparatus 20 also preferably includes a control panel 30 to allow the operator to activate the machine through the use of coins or bills or, in the preferred embodiment, through the use of a magnetically or otherwise encoded card which is inserted in the machine to cause it to operate. Details regarding applicable activation mechanisms are known and will not be described in more detail herein. Furthermore, the present invention could be operated simply through a simple on/off switch in situations where payment is not required.

Referring now to FIGS. 1, 4, 5 and 5A–5C, sub-assembly 40 is mounted within the framework 22 of apparatus 20 and includes a platform 42 mounted on rails 41 for longitudinal motion (i.e., generally parallel to the longitudinal axis of the blade) within apparatus 20. Platform 42 preferably includes a pair of clamps 44 which hold the blades of one pair of skates in position for sharpening, although it will be understood that one or three or more clamps could be provided as desired. Platform 42 is preferably moved along rails 41 using motor and screw drive 62 which rotates to move platform 42 along rails 41.

Figure 5:
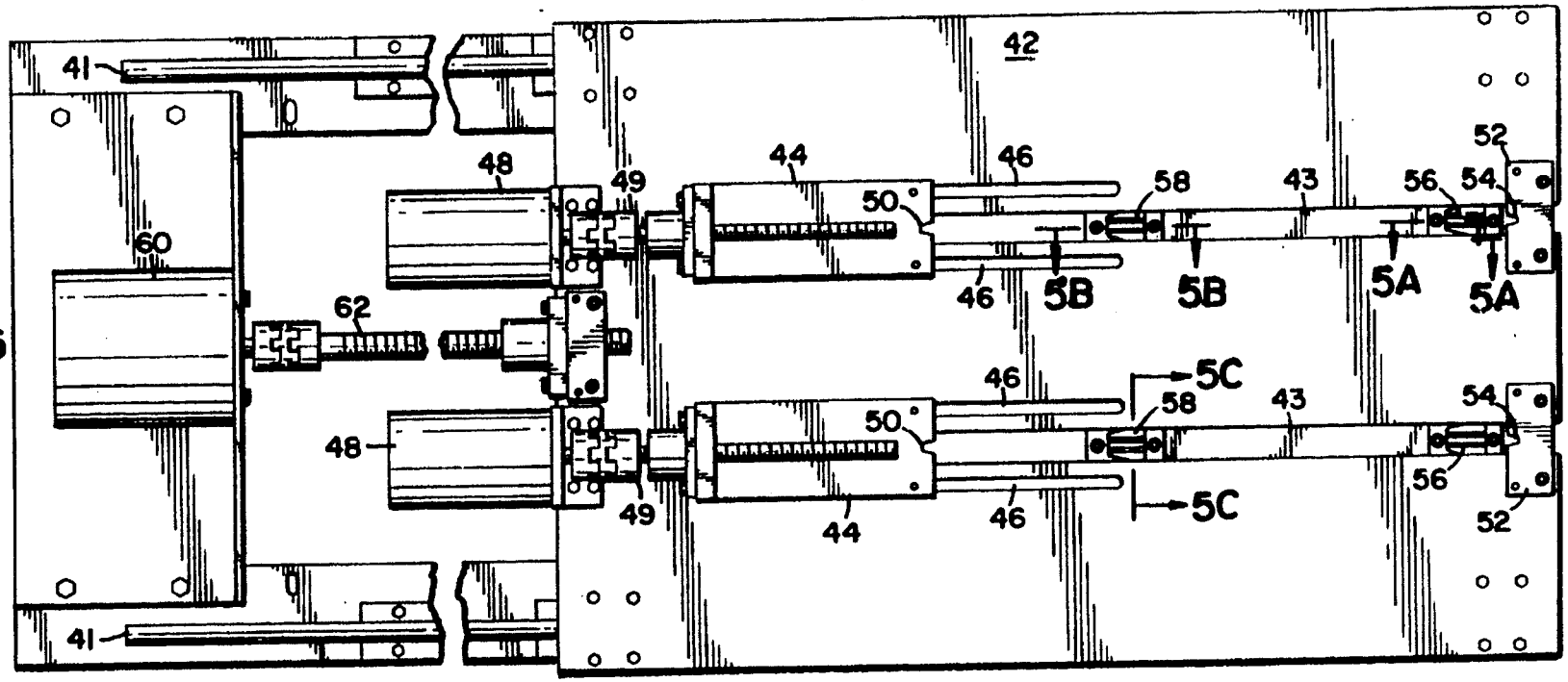
FIG. 5 is a top view of the skate platform in which the skates to be sharpened are positioned in the apparatus of FIG. 2.
Figure 6:
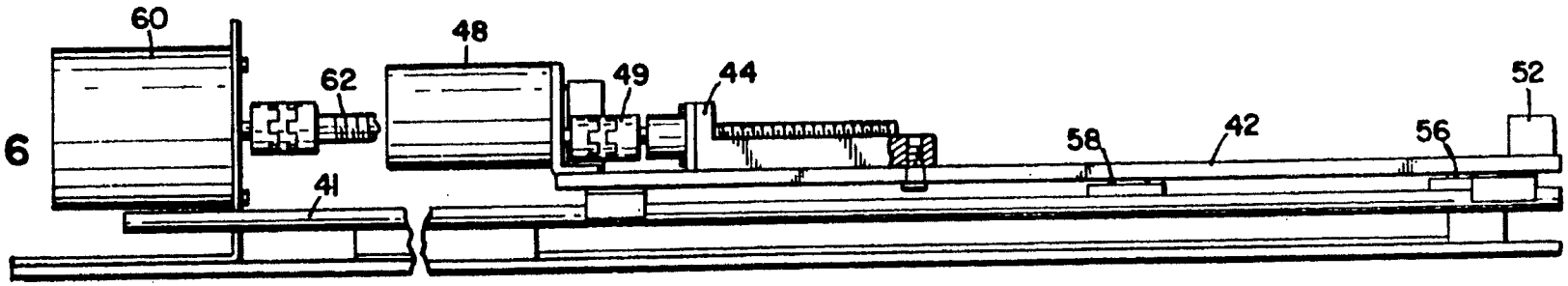
FIG. 6 is a side elevational view of FIG. 5.
Figure 8:
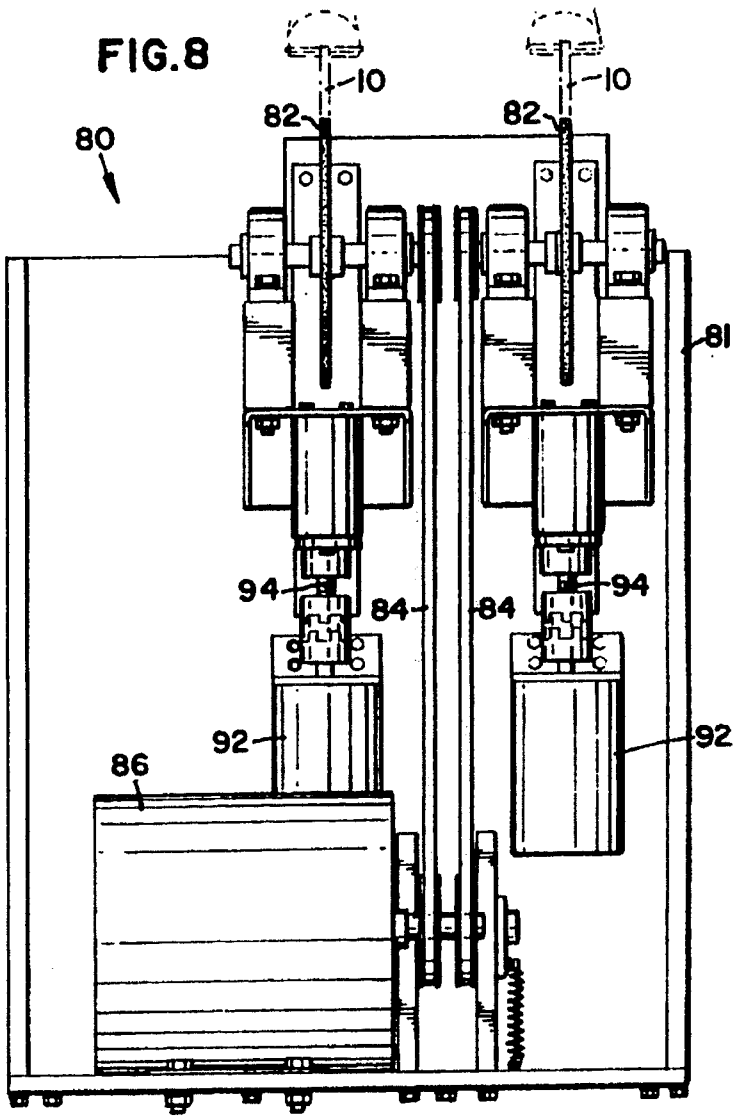
FIG. 8 is a front elevational view of FIG. 7.
Figure 7:
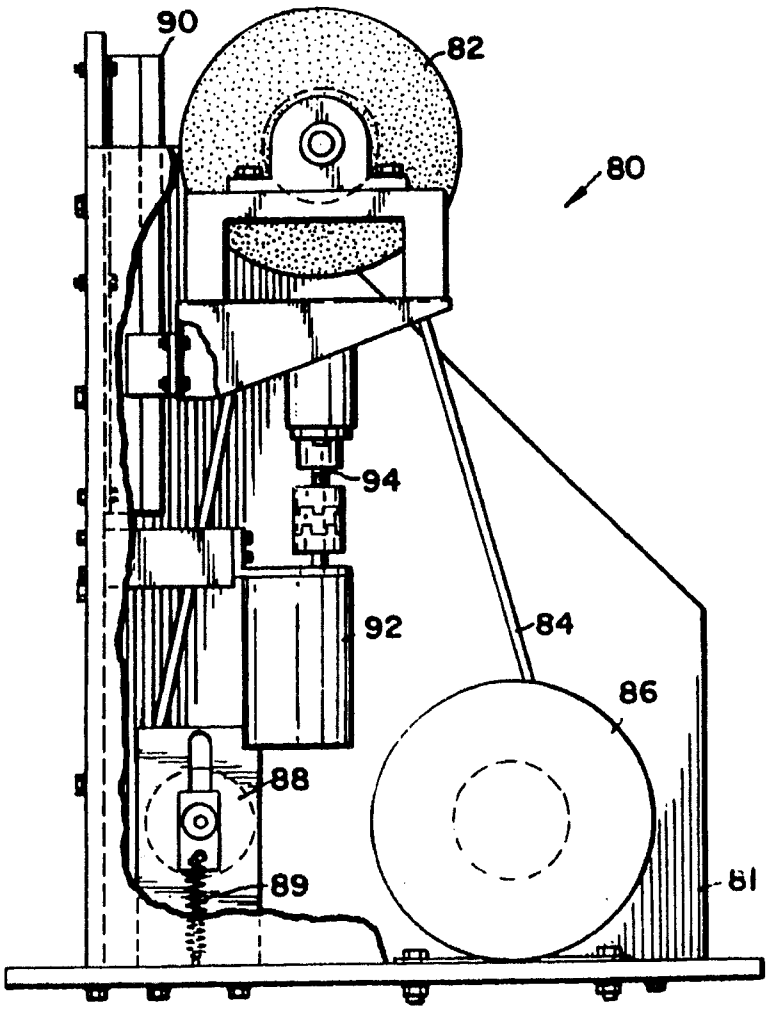
FIG. 7 is a side elevational view of the grinding wheel and associated components of the apparatus depicted in FIG. 2.

Referring now to FIG. 5, platform 42 is mounted on longitudinal rails 41 as described above. Platform 42 is moved along rails 41 through the use of platform motor 60 and screw 62 which is operatively attached to platform 42 as depicted in FIG. 5. Motor 60 is preferably a stepper motor manufactured by Superior Motor Products, although other known motors may be used in the alternative. It will be understood that rotation of screw 62 will move platform 42 in either desired direction.

Platform 42 preferably includes two substantially parallel slots 43, each formed to receive the blade of a skate. At one end of each of slots 43 a stop 52 is located which includes a groove 54 for receiving and centering the end of a skate blade. Located beneath slot 43 are two pairs of stationary blade centering blocks 56 and 58. Blocks 56 are stationary both in the vertical and horizontal planes when platform 42 is moved. FIG. 5A depicts a cross-sectional view of one block 56 taken along line 5A—5A.

The second pair of alignment blocks 58 are also mounted stationary with respect to platform 42, although, referring to FIG. 5B, each of the blocks 58 are mounted on a spring loaded post 59 to allow them to move slightly in the vertical plane as a skate blade is passed over them when platform 42 is moved along rails 41.

Referring now to FIG. 5C, each of blocks 58 and 56 is provided with side walls forming their slots which are angled off of vertical by angle $\alpha$ as indicated in FIG. 5C. In the preferred embodiment, angle $\alpha$ is approximately 10° although other angular offsets are anticipated.

Alignment blocks 56 and 58 are preferably constructed of a material which is softer than the material used for skate blades, yet durable enough to withstand use by the general public. In the preferred embodiment, blocks 56 and 58 are formed out of aluminum.

Platform 42 also includes slidable clamps 44 mounted in slots 46 as depicted in FIG. 5. Each clamp 44 is moved along slots 46 using a clamp motor 48 coupled to each slide 44 through the use of screw drives 49. Motors 48 are preferably stepper motors manufactured by Superior Motor Company, although other motors may be used in the alternative. The advantage of the stepper type motors is that they lock when they are not activated, thereby maintaining a clamping force along the longitudinal axis of the blade when no driving signal is applied to the motors. After one or more skates have been placed in slots 43 and door 26 has been closed, clamps 44 are moved along slots 46 to clamp a skate blade in position between slots 50 in clamps 44 and slots 54 in end stops 52. Alignment blocks 56 and 58 serve to aid in aligning the skate blades within slots 43.

Because platform 42 is moved along slides 41 and alignment blocks 56 and 58 are stationary, platform 42 can be moved before the start of grinding so that stationary blocks 56 and 58 do not interfere with the movement of the grinding wheel relative to the skate blades.

The preferred clamping assembly offers several advantages over conventional devices. In the preferred assembly, skate blades are clamped end-to-end (i.e., provide a clamping force along the longitudinal axis of the blade), in contrast to prior designs where clamps engage the sides of a blade. It is believed that the end-to-end clamping offers greater stability, particularly for worn blades which may have a great deal of material removed from the blade by prior sharpening. In addition, in the preferred assembly, the length of skate blades may be calculated as a function of the rotation of each clamp motor 48, which preferably provides a position signal from which the position of the clamp may be determined. This eliminates the need for separate position sensors such as photosensors, etc., which add cost and complexity to an apparatus, and may not provide as accurate positional measurements.

Furthermore, although an automatic clamping/measuring means is described above with respect to the preferred embodiment, it will be understood that a manual clamping system which includes a system of detecting the length of the skate blades could be substituted for the preferred clamping/measuring means.

Referring now to FIGS. 2, 4, 7 and 8, the apparatus and method of grinding the skate blades will be further described. As depicted in FIG. 2, the preferred grinding means consists of an apparatus 80 which includes a pair of grinding wheels 82 each of which is driven by a belt 84 driven by a single motor 86. Alternately, it will be understood that individual motors could be provided to drive each grinding wheel 82 separately.

Grinding assembly 80 is provided with a subframe 81 on which each grinding wheel 82 and associated components are independently mounted. The preferred grinding wheel is available from Cincinnati Milacron under the designation 3MSB1001-18-VSA, 7"×¼"×⅝". Other grinding devices, e.g., belts, discs, etc. may also be used. In a preferred embodiment, each grinding wheel 82 and its associated components are mounted for independent motion in the vertical direction (i.e., a direction generally perpendicular to the bottom surface of the blade) to compensate for differences in the height of skate blades 10 clamped in assembly 40 which includes platform 42.

Each grinding wheel 82 moves in a vertical direction along a pair of vertically disposed rails 90 which are mounted to grinding assembly frame 81. Each grinding wheel 82 is moved vertically by a profile motor 92 which drives a grinding wheel 82 through the use of a screw drive 94. Motor 92 is preferably a stepper motor manufactured by Superior Motor Company, although other motors or structure which may provide position signals from which positioning of the grinding wheel may be obtained, while exerting an upward force on the skate blades with the grinding wheel, may also be used.

Because grinding wheels 82 are movable in a vertical direction, belts 84 are preferably routed around idler pulleys 88 which are spring loaded using springs 89 to grinding assembly frame 81. By spring loading idler pulleys 88, tension is maintained for each individual belt 84 as each grinding wheel 82 moves vertically to grind a skate blade 10.

Figure 9:
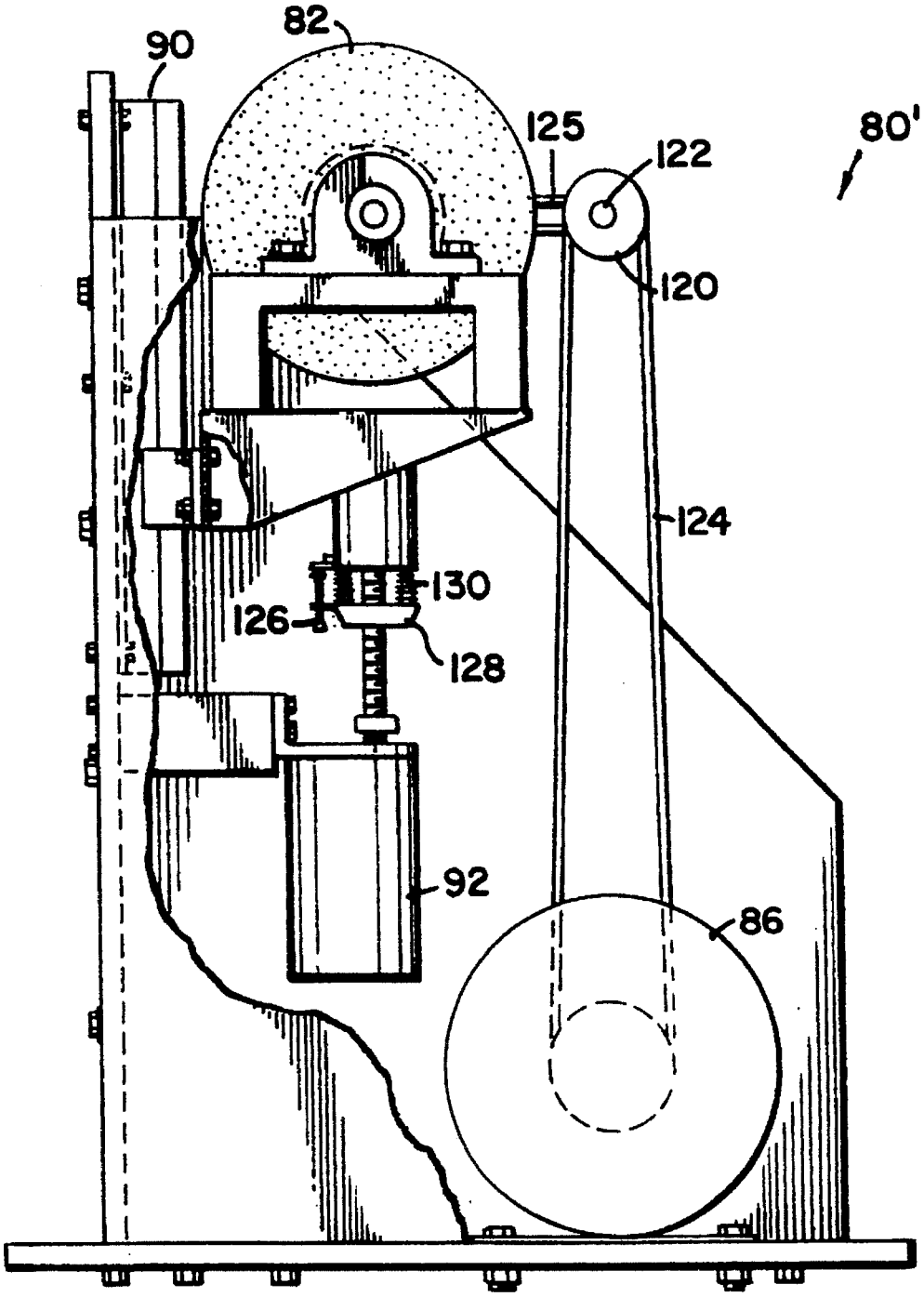
FIG. 9 is a side elevational view of an alternate grinding assembly to that depicted in FIG. 2.

In the alternative, as shown by assembly 80' in FIG. 9, a pair of belts 124 and 125 may be used to drive each grinding wheel 82 with motor 86. A fixed shaft 122 includes a pair of pulleys, e.g., pulley 120 for belt 124, with the corresponding pulley for belt 125 being hidden in FIG. 9. In this configuration, idler pulleys are not required, as the vertical movement of grinding wheel 82 will not substantially change the tension in belt 125.

Control over the grinding force applied in the grinding process is provided by each motor 92. In a preferred apparatus and method, the force of grinding wheel 82 against a skate blade 10 may be monitored using a switch coupled between the motor 92 and grinding wheel 82. As shown in FIG. 9, a switch 126 may be spring loaded by one or more springs 130 coupled to bearing 128. Preferably springs 130 provide four pounds of force, such that switch 126 will close upon four pounds of force applied by grinding wheel 82 on a skate blade. Alternatively, the load of motor 92 may be monitored to control the force exerted by grinding wheel 82 against a skate blade.

With the exception of drive motor 86, all of the motors described with respect to the preferred embodiment are DC stepper motors which provide accurate controllable and repeatable motion which is important to provide the necessary accuracy in all facets of the present machine. Alternately, it will be understood that other motors can be used if additional means or methods of determining positioning of clamps 44 which fix skate blades within platform 42 or an alternate means of providing grinding force each blade 10 by each grinding wheel 82 is provided.

Therefore, it will be appreciated that the preferred apparatus provides first and second moving mechanisms for varying the spatial relationship between the blade or clamping assembly and the grinding wheel. The first direction of relative motion is generally parallel to the longitudinal axis of the blade, which in a preferred embodiment occurs through the activation of motor 60 moving platform 42 relative to the grinding wheel. The second direction of relative motion is generally perpendicular to the bottom surface of the blade, which is a preferred embodiment occurs through the activation of motors 92 moving the grinding wheel relative to the platform. However, it will be appreciated that other relative motions may occur, e.g., moving the grinding wheel in the first direction in lieu of or in addition to the platform, and/or moving the platform in the second direction in lieu of or in addition to the grinding wheel. In addition, various other translation, pivoting or rotational mechanisms may be contemplated to provide similar relative motions.

Figure 10:
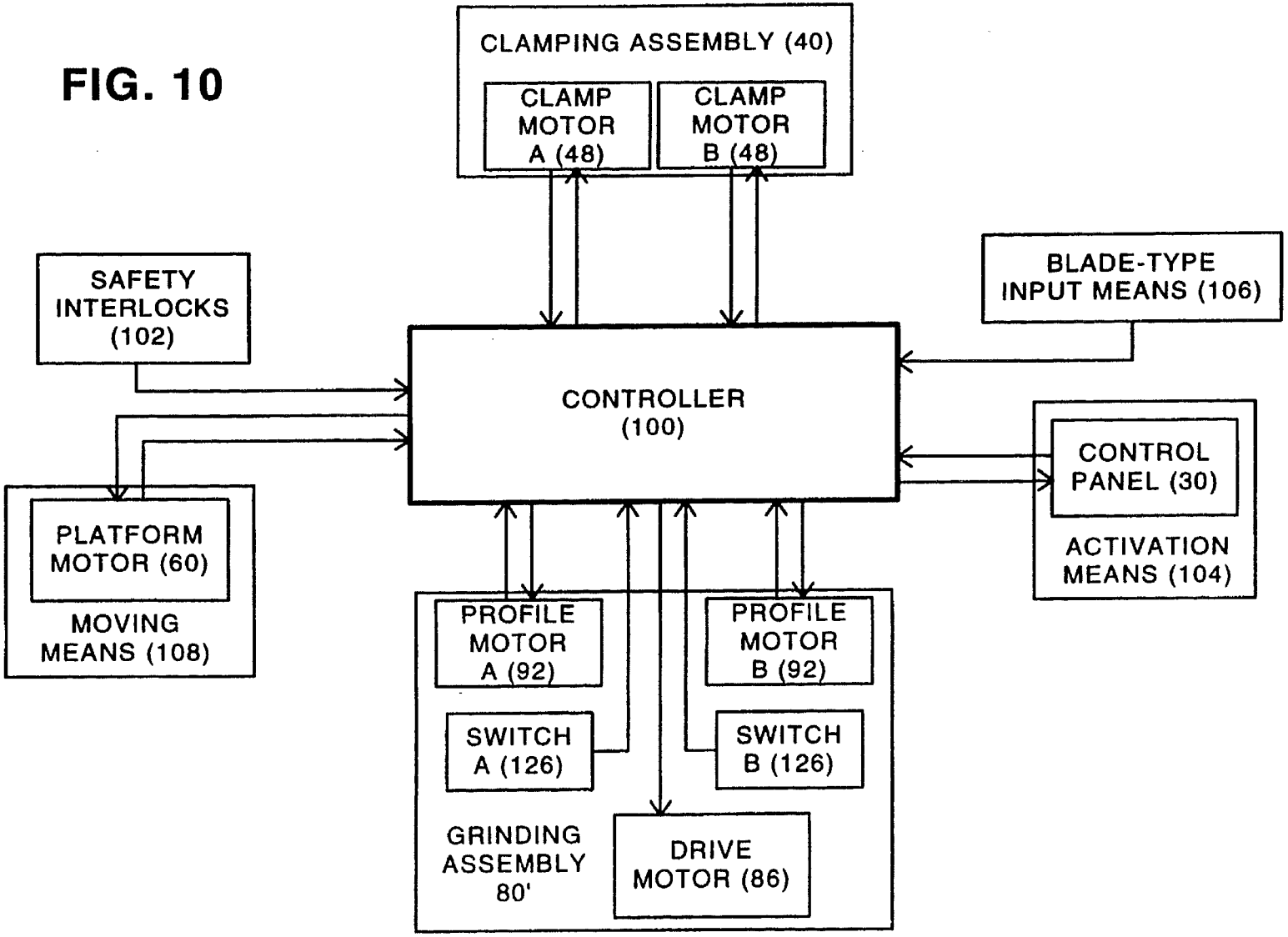
FIG. 10 is a block diagram of one control system for the apparatus depicted in FIG. 2.

Referring now to FIG. 10, a block diagram of the preferred control system of the preferred embodiment of the present invention is depicted. The preferred control system comprises a controller 100 operatively connected to a set of safety interlocks 102 which prevent operation of the apparatus 20 when any of the panels 24 have been removed from the machine or if door 26 is in the open position. Controller 100 is preferably a Model 2200 Autocontroller manufactured by Control Tech Corporation. Controller 100 may include any combination of programmable controllers, hardwired control circuits, or any other suitable method/means of control.

Controller 100 also receives inputs from the activation means 104 which includes control panel 30. The activation means will preferably rely on the use of magnetically or otherwise coated cards or other devices and can also be used in conjunction with coins or bills which cause the machine to activate. Such devices and methods will be well known to those skilled in the art and will not be further described herein.

Controller 100 also is operatively connected to clamping assembly 40, in particular to both clamp motors 48 (designated "clamp motor A" and "clamp motor B"), to clamp down each individual skate blade, and to determine the length of each blade. The operation of these assemblies will be discussed further below.

Controller 100 is operatively connected to a moving means 108 which, in the preferred embodiment, primarily includes platform motor 60, which drives platform 42 along rails 41 as described above. Controller 100 moves platform 42 as needed to obtain the required grinding characteristics. Although the preferred embodiment moves the platform 42 to which skates are attached, it will be understood that any means of providing relative motion between the blades and the grinding wheels is contemplated as falling within the scope of the present invention.

Controller 100 is also operatively connected to either grinding assembly 80 or assembly 80' to operate grinding wheels 82 at the desired force against a skate blade as described above. For example, FIG. 10 shows the connection of the components of grinding assembly 80' (of FIG. 9) in greater detail. In particular, controller 100 may provide a driving signal to drive motor 86 to drive both grinding wheels 82. In addition, controller 100 may provide a driving signal to each motor 92 (designated "profile motor A" and "profile motor B"), and receive position and/or load (e.g., current) signals therefrom to assist in determining the position of each grinding wheel. Controller 100 also receives an input from switches 126 (designated "switch A" and "switch B") indicating whether a force is being exerted against a skate blade by either grinding wheel.

A blade type input means 106 may also be operatively connected to the controller 100 to allow the user to indicate the type of blade (e.g., hockey, goalie or figure), or the desired radius, to use in sharpening, as an alternative to the purely automatic profile generation discussed herein. Typically, the choice may be entered via a dial, buttons, etc. As will be discussed, it may be desirable to select a blade type, either to distinguish figure skates which have a notched blade portion that is not sharpened, or to allow a customer greater flexibility in sharpening the blades, for example.

Figure 11:
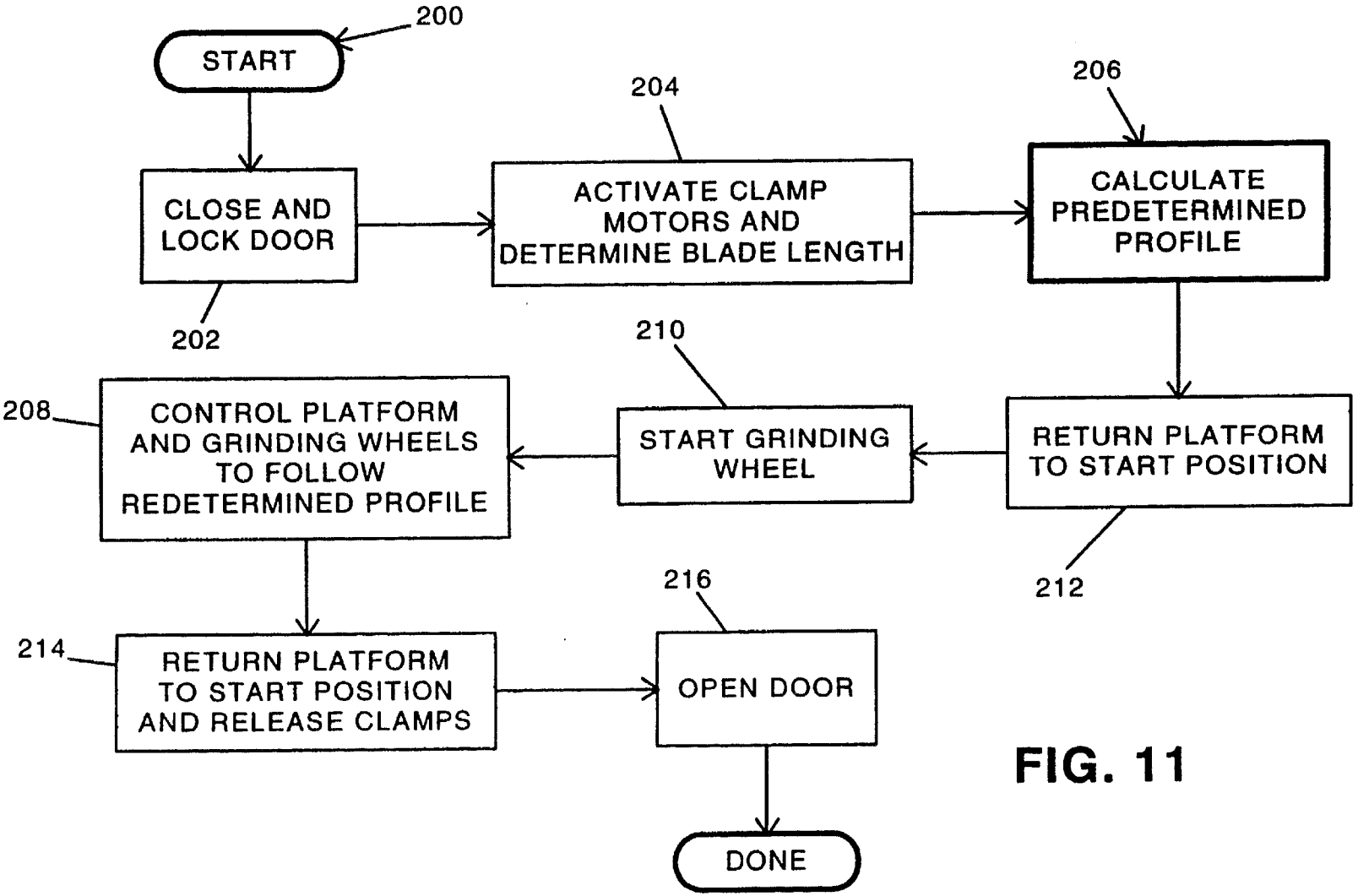
FIG. 11 is a flowchart showing one program flow for the apparatus depicted in FIG. 2.

The preferred method of grinding will now be described with reference to FIGS. 11 and 12. First, as shown in FIG. 11, a routine 200 is utilized by controller 100 to operate apparatus 20 to operate according to the preferred method. Routine 200 will generally be executed after a user has input the necessary currency (whether via coins, bills, credit card, etc.) to satisfy activation means 104. Alternatively, in non-vending applications, routine 200 may be executed without payment if desired.

A user may also be required to input a skate type (e.g., hockey, goalie or figure) and/or a preferred radius using blade-type input means 106. As will be discussed, the preferred apparatus is capable of determining a preset radius without separate input from a user. However, for greater flexibility, as well as to distinguish figure skates (which include a notched front portion that should not be sharpened), a separate blade-type input is desired.

The first step of routine 200 is to close and lock the door in block 202. After payment, an operator will preferably open door 26 to place one or two skates within slots 43 in platform 42. As described above, each blade 10 is centered within slot 43 using blocks 56 and 58. After the skates are in position, routine 200 closes door 26 and preferably activates a solenoid lock to prevent the door from being opened while the apparatus is in use. The closing of the door may be initiated by a push-button on the control panel which is pressed by a user once the skates are in place, or may be initiated after a preset time period after payment is received, for example.

Assuming the door has closed and all of the safety interlocks are satisfied, control passes to block 204 to activate clamp motors 48 to slide clamps 44 along slides 46 to clamp the skates onto platform 42. The clamps 44 force the opposite end of each skate blade 10 against back stop 52.

The point at which the blades are firmly clamped between clamps 44 and stops 52, and therefore where motors 48 may be shut off, is preferably determined by monitoring B the load of each motor 48 and shutting off the motors when they have exceeded a preset value representing the desired clamping force on the blades.

Once clamps 44 have operatively engaged each blade 10, the number of revolutions of each motor 48 needed to provide clamping of the blades is measured for each clamp. The distance traveled by each clamp 44 may then be determined based upon the known pitch of each screw drive 49. For example, each revolution of each motor 48 and attached screw drives 49 may be counted. When multiplied by the appropriate factor based on the pitch of screws 49 of the distance moved by clamps 44 can be computed for each skate blade. Because the positions of back stops 52 and clamps 44 are known, a blade length can be computed for each of the blades clamped within slots 43 in platform 42.

Next, control passes to block 206 to calculate the predetermined profile for each grinding wheel. In a preferred embodiment, the desired profile is calculated based upon the measured radius of each blade sensed by the apparatus.

Figure 12:
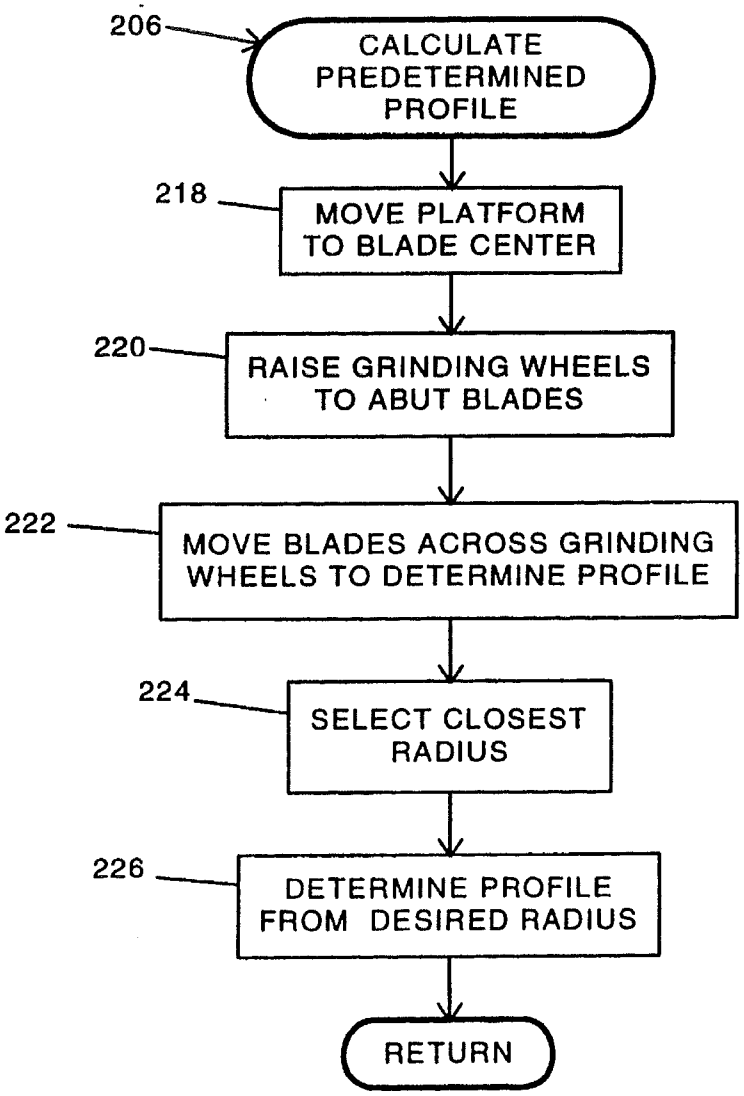
FIG. 12 is a flowchart of the CALCULATE PREDETERMINED PROFILE of FIG. 11.

For example, FIG. 12 shows one embodiment of the predetermined profile calculating routine 206. First, in block 218, platform 42 is moved to locate the grinding wheels directly under the centerpoints of each blade. It will be appreciated that the blade centers may be determined by taking ½ of the blade length calculated in block 204 of FIG. 11.

Next, in block 220, grinding wheels 82 are raised by motors 92 to abut the bottom edges of blades 10. The point at which each grinding wheel abuts a blade is preferably determined by sensing each switch 126. Alternatively, the load of each motor 92 may be monitored to detect when a blade is contacted.

Next, in block 222, platform 42 is moved rearward (from the front of the machine) to locate the grinding wheels proximate the rear of each blade and then forward (toward the starting position) across each blade, while maintaining substantially constant force applied by the grinding wheels on the blades. The force exerted by each grinding wheel may be maintained either by monitoring each switch 126, or monitoring the load of each motor 92. Maintaining constant force on each skate blade while platform 42 is moved across the grinding wheels will cause each grinding wheel to ride along the surface of the bottom edge of each skate blade. Accordingly, by monitoring the vertical position (from the measured number of revolutions of the stepper motor 92 and the known pitch of screw drives 94) of each motor 92 for each position of the platform, a profile of each skate blade may be determined.

By using known geometric and/or curve-fitting calculations on either the entire or just a portion of the skate blade profile, a radius for each skate blade may be calculated. Only a portion of the skate blade profile may be desired in certain instances, e.g., if the blades were improperly sharpened such that too much material was removed from the ends of the blades.

Next, in block 224, a desired radius is selected which is closest to the radius or profile calculated for the blades (e.g., 4, 9, 11, 13 or 28 feet for most skates). In addition, if a particular radius is selected (e.g., on input means 106), this desired radius may be used in lieu of, or as a component in, the calculation of the desired radius.

Next, in block 226, the desired radius is used to generate a predetermined profile for the grinding wheels, using the known length and position of each blade on the platform, as well as the known vertical position of each grinding wheel at the center point of each blade. The profile will preferably be represented by a table or array of vertical position values for each profile motor 92, indexed by the position of platform 42. In addition, if a figure skate is detected (e.g., when the profile of the blade indicates a 4 foot radius, or if "figure skate" is selected on input means 106), the profile may be modified to lower the grinding wheels proximate the notched portion of the skate blades, to thereby prevent them from being sharpened. Once the profile has been generated in block 226, control returns to routine 200.

Returning to FIG. 11, in another embodiment, the predetermined profile may be calculated in block 206 simply from the blade type and/or radius selected by a user on input means 106. From a known radius (either input by a user, or determined from the blade type—e.g., 4 feet for figure skates, 9, 11, or 13 feet for hockey skates, 28 feet for goalie skates, etc.) and a known blade length (calculated in block 204), controller 100 is able to compute both the center of the blade (using primarily the length of the blade which is divided in half), and the profile (i.e., the precise movements) of each grinding wheel necessary to produce the desired radius on the blades. It will be appreciated that it may be necessary to move the platform to center the blades over the grinding wheels, and then move the grinding wheels upward to locate the bottom edge of each blade, to calculate appropriate starting points (i.e., vertical positions) for the profiles of the grinding wheels, in the manner discussed above.

Once the above information has been computed in either of the above-described manners, platform 42 is returned to the "start" position in block 212 by activating platform motor 60. Next, grinding wheels 82 are started in block 210 by activating drive motor 86.

Next, in block 208, the motions of grinding wheels 82 and platform 42 are coordinated using motors 92 and 60, respectively, to cause the blades to be sharpened according to the predetermined profiles calculated above. It will be appreciated that this may be performed by coordinating the vertical positioning of each motor 92 as platform 42 moves past the grinding wheels, e.g., using the position of the platform as an index to the array of vertical positions for motors 92.

The force of each grinding wheel 82 against each skate blade 10 is preferably provided by motors 92. The profiles should be calculated such that sufficient force will be generated by the grinding wheels on the blades. However, it is also preferable to monitor the force during grinding to ensure that excessive force is not being supplied to the blades. This may be performed by monitoring the load on each motor 92, or alternatively, by monitoring switches 126 and detecting whether they have closed. In such instances, the profile may be overridden or recalculated if necessary to slightly lower the grinding wheels and decrease the force exerted on the blades.

It will be appreciated that the grinding force on the blades is not provided by a counterweight system which would only cause bouncing and chattering of grinding wheels 82 against each skate blade 10 as described above. The preferred stepper motors 92 and associated screw drives 94 provide a source of positive, controllable, repeatable force exerted by grinding wheels 82 against each skate blade 10, which features are not available using counterweight balanced systems.

The grinding process can consist of a single pass of each grinding wheel 82 over each blade 10 or, alternately, the grinding process can consist of more than one pass when a "heavier" grind is desired. For example, in instances where too much material was previously removed from the ends of a blade due to improper sharpening, additional passes may be required to return the blade to its proper profile. Such choices can be provided to the operator using control panel 30 and may require additional credits from a card or additional money.

Once the blades have been ground in block 208, platform 42 is returned to the starting position in block 214. In addition, drive motor 86 is deactivated, grinding wheels 82 may be lowered by motors 92, and clamps 44 may be withdrawn by motors 48 to release each blade. Finally, once the blades are released and all moving components are de-activated on the apparatus, the door may be opened in block 216 to permit the customer to remove the sharpened skates. Then, the door is closed and the apparatus awaits another customer.

Various modifications may be made without departing from the spirit and scope of the invention. For example, any number of blades (e.g., one or more) may be sharpened concurrently in the apparatus. In addition, a separate wheel dressing operation may be periodically performed to dress the grinding wheels. Also, a vacuum system may be used to collect ground material generated during sharpening. Further, various customer actuation data may be stored and maintained by controller 100 to assist in monitoring use of the apparatus. Other changes will be appreciated by one skilled in the art.

It will thus be appreciated that the preferred apparatus and method may be used to sharpen a skate blade to manufacturer's specifications or another custom profile substantially independently on any pre-existing defects in the blade, thereby correcting any such defects. Although a specific embodiment and method have been illustrated and described herein, it will be appreciated by those of ordinary skill in the art that any arrangement which is calculated to achieve the same purpose may be substituted for the specific embodiment and method shown. This application is intended to cover any adaptations or variations of the present invention and it is intended that the invention be limited only by the claims and the equivalents thereof.

We claim:

1. A method of automatically sharpening an ice skate blade comprising the step of controlling movement of a rotating grinding wheel relative to the blade in first and second directions such that the grinding wheel grinds the blade according to a predetermined profile that is representative of an arc having a predetermined radius, the first direction being generally parallel to a longitudinal axis of the blade, and the second direction being generally perpendicular to a bottom surface of the blade; whereby the grinding wheel does not rely on a pre-existing profile of the blade when grinding the blade.

2. The method of claim 1, further comprising the step of clamping the blade end-to-end with a pair of oppositely disposed clamps.

3. The method of claim 2, further comprising the step of determining the length of the blade from a position signal generated by a stepper motor coupled to at least one of the clamps through a screw drive.

4. The method of claim 1, wherein the controlling step includes the step of moving the grinding wheel relative to the blade in the first direction by activating a stepper motor coupled to a platform through a screw drive, the platform including a clamping assembly for supporting the blade.

5. The method of claim 1, wherein the controlling step includes the step of moving the grinding wheel relative to the blade in the second direction by activating a stepper motor coupled to the grinding wheel through a screw drive.

6. The method of claim 1, further comprising the step of detecting the force exerted by the grinding wheel on the blade.

7. The method of claim 1, further comprising the step of selecting the predetermined radius based upon a skate type input by a user, wherein the skate type includes a hockey skate, a goalie skate and a figure skate.

8. The method of claim 21, further comprising the step of determining a current profile for the blade including the steps of:

(a) moving the grinding wheel along the blade in the first direction while the grinding wheel is not activated;

(b) moving the grinding wheel relative to the blade in the second direction such that the grinding wheel exerts a substantially constant force on the blade as the grinding wheel moves along the blade in the first direction; and (c) recording the movement of the grinding wheel in the second direction.

9. The method of claim 8, further comprising the steps of:

(a) selecting a closest radius from a list of radii corresponding to different skates;

(b) determining a position offset representative of the position of the grinding wheel in the second direction when the grinding wheel abuts the blade proximate a midpoint thereof;

(c) determining a length of the blade; and (d) generating the profile from the closest radius, the position offset and the blade length.

10. An apparatus for sharpening an ice skate blade comprising:

(a) a clamping assembly for clamping the blade;

(b) a grinding wheel;

(c) a first motor for varying the spatial relationship between the clamping assembly and the grinding wheel in a direction generally parallel to a longitudinal axis of the blade;

(d) a second motor, coupled to the grinding wheel through a screw drive, for varying the spatial relationship between the clamping assembly and the grinding wheel in a direction generally perpendicular to a bottom surface of the blade, wherein the second motor applies a grinding force for the grinding wheel against the blade; whereby rotation of the second motor moves the grinding wheel in a direction generally perpendicular to the bottom surface of the blade; and (e) a controller for activating the first and second motors to grind the blade.

11. The apparatus of claim 10, wherein the clamping assembly includes a pair of oppositely disposed clamps, at least one clamp being movable in a direction generally parallel to the longitudinal axis of the blade to apply a clamping force along the longitudinal axis of the blade.

12. The apparatus of claim 11, wherein the clamping assembly further includes a third motor coupled to the movable clamp through a screw drive and providing a position signal representative of the position of the third motor, and wherein the controller determines the length of the blade from the position signal.

13. The apparatus of claim 10, wherein the clamping assembly is mounted to a platform which is slidable along at least one rail oriented generally parallel to the longitudinal axis of the blade, and wherein the first motor is coupled to the platform through a screw drive.

14. The apparatus of claim 1, further comprising a drive motor, coupled to the grinding wheel, for rotating the grinding wheel about an axis thereof.

15. An apparatus for sharpening an ice skate blade comprising:

(a) clamping means for clamping the blade in a fixed position;

(b) grinding means for grinding the blade;

(c) first moving means for varying the spatial relationship between the clamping means and the grinding means in a direction generally parallel to a longitudinal axis of the blade;

(d) second moving means for varying the spatial relationship between the clamping means and the grinding means in a direction generally perpendicular to a bottom surface of the blade; and (e) control means for activating the first and second moving means to grind the blade according to a predetermined profile, the predetermined profile being representative of an arc of predetermined radius; whereby the grinding means does not rely on a pre-existing profile of the blade when grinding the blade.

16. The apparatus of claim 15, wherein the clamping means includes a pair of oppositely disposed clamps, at least one clamp being movable in a direction generally parallel to the longitudinal axis of the blade to apply a clamping force along the longitudinal axis of the blade.

17. The apparatus of claim 11, wherein the clamping means further includes a stepper motor coupled to the movable clamp through a screw drive and providing a position signal representative of the position thereof, and wherein the control means includes means for determining the length of the blade from the position signal.

18. The apparatus of claim 15, wherein the clamping means is mounted to a platform which is slidable along at least one rail oriented generally parallel to the longitudinal axis of the blade, and wherein the first moving means includes a stepper motor coupled to the platform through a screw drive.

19. The apparatus of claim 15, wherein the grinding means includes:

(a) at least one grinding wheel rotatable about a rotational axis generally perpendicular to the longitudinal axis of the blade; and (b) a drive motor for rotating the grinding wheel about the rotational axis.

20. The apparatus of claim 19, wherein the second moving means moves the grinding wheel and includes a stepper motor coupled to the grinding wheel through a screw drive; whereby rotation of the second motor moves the grinding wheel in a direction generally perpendicular to the bottom surface of the blade.

21. The apparatus of claim 20, wherein the second moving means includes a switch, coupled to the grinding wheel, for detecting when the force exerted by the grinding wheel on the blade exceeds a predetermined level.

22. The apparatus of claim 15, further comprising user input means for receiving a skate type selected by a user, wherein the skate type includes a hockey skate, a goalie skate and a figure skate, and wherein the control means includes means for determining the predetermined radius from the skate type.

23. The apparatus of claim 22, wherein the predetermined radius for a hockey skate is about 9 to 13 feet, the predetermined radius for a goalie skate is about 28 feet and the predetermined radius for a figure skate is about 4 feet.

24. The apparatus of claim 7, wherein the control means includes profile determining means for determining the current profile for the blade, the profile determining means operating by activating the first and second moving means to move the grinding means along the blade with a substantially constant force applied thereto while recording the spatial relationship between the clamping means and the grinding means in the direction generally perpendicular to the bottom surface of the blade.

25. The apparatus of claim 24, wherein the control means further includes radius selecting means for selecting a closest radius from a list of radii corresponding to different skates, and profile generating means for generating the profile corresponding to the closest radius.

26. The apparatus of claim 25, wherein the control means includes position sensing means for activating the first and second moving means to determine the position of the grinding means relative to the clamping means in the direction generally perpendicular to the bottom surface of the blade while the grinding means is located proximate a midpoint of the blade.

27. The apparatus of claim 15, wherein the clamping means includes means for clamping a second blade in a fixed position next to the first blade, wherein the second moving includes means for varying the spatial relationship between the grinding means and the second blade, and wherein the control means activates the first and second moving means to grind the blades according to independent profiles.

28. An apparatus for sharpening an ice skate blade comprising:

(a) a clamping assembly for clamping the blade, the clamping assembly including a pair of oppositely disposed clamps, at least one clamp being movable in a direction generally parallel to the longitudinal axis of the blade to apply a clamping force along the longitudinal axis of the blade;

(b) a grinding wheel;

(c) a first motor for varying the spatial relationship between the clamping assembly and the grinding wheel in a direction generally parallel to a longitudinal axis of the blade;

(d) a second motor for varying the spatial relationship between the clamping assembly and the grinding wheel in a direction generally perpendicular to a bottom surface of the blade, wherein the second motor applies a grinding force for the grinding wheel against the blade;

(e) a third motor coupled to the movable clamp through a screw drive and providing a position signal representative of the position of the third motor; and (f) a controller for activating the first and second motors to grind the blade, wherein the controller determines the length of the blade from the position signal.

29. An apparatus for sharpening a pair of ice skate blades comprising:

(a) clamping means for clamping first and second blades in fixed positions next to one another;

(b) grinding means for grinding the blades;

(c) first moving means for varying the spatial relationship between the clamping means and the grinding means in a direction generally parallel to longitudinal axes of the blades;

(d) second moving means for varying the spatial relationship between the clamping means and the grinding means in a direction generally perpendicular to bottom surfaces of the blades; and (e) control means for activating the first and second moving means to grind the blades according to independent and predetermined profiles.

* * * * *

UNITED STATES PATENT AND TRADEMARK OFFICE
CERTIFICATE OF CORRECTION

PATENT NO. : 5,601,473

DATED : February 11, 1997

INVENTOR(S) : Strain et al

It is certified that error appears in the above-identified patent and that said Letters Patent is hereby corrected as shown below:

In the abstract, line 1, the word "operate" should read --operated--.

On column 6, line 52, please insert the --connected-- after the # "89".

On column 9, line 3, delete "B" after the word "monitoring".

On column 11, line 31, "independently" should read --independent--.

On column 11, line 31, please delete "on" and substitute therefor --of--.

On column 12, line 7 (claim 8), "21" should read --1-- as the claim's dependency is incorrect.

UNITED STATES PATENT AND TRADEMARK OFFICE

CERTIFICATE OF CORRECTION

PATENT NO. : 5,601,473

DATED : February 11, 1997

INVENTOR(S) : Strain et al

It is certified that error appears in the above-indentified patent and that said Letters Patent is hereby corrected as shown below:

On column 13, line 23 (claim 17), "11" should read --16-- as the claim's dependency is incorrect.

On column 13, line 61 (claim 24), "7" should read --15-- as the claim's dependency is incorrect.

On column 14, line 17 (claim 27), insert --means-- after the word "moving".

Signed and Sealed this

Twenty-first Day of October 1997

*Attest:*

Bruce Lehman

BRUCE LEHMAN

*Attesting Officer*

*Commissioner of Patents and Trademarks*